US011519118B2

(12) United States Patent
Kirisken

(10) Patent No.: US 11,519,118 B2
(45) Date of Patent: Dec. 6, 2022

(54) WASHING MACHINE AND METHOD OF OPERATION

(71) Applicant: Vestel Elektronik Sanayi ve Ticaret A.S., Manisa (TR)

(72) Inventor: Barbaros Kirisken, Manisa (TR)

(73) Assignee: VESTEL ELEKTRONIK SANAYI VE TICARET A.S., Manisa (TR)

( * ) Notice: Subject to any disclaimer, the term of this patent is extended or adjusted under 35 U.S.C. 154(b) by 0 days.

(21) Appl. No.: 17/620,384

(22) PCT Filed: Jun. 18, 2019

(86) PCT No.: PCT/EP2019/066003

§ 371 (c)(1),
(2) Date: Dec. 17, 2021

(87) PCT Pub. No.: WO2020/253945

PCT Pub. Date: Dec. 24, 2020

(65) Prior Publication Data

US 2022/0205158 A1 Jun. 30, 2022

(51) Int. Cl.
*D06F 33/40* (2020.01)
*D06F 39/08* (2006.01)
(Continued)

(52) U.S. Cl.
CPC ..... *D06F 33/40* (2020.02); *D06F 39/087* (2013.01); *D06F 2103/18* (2020.02); *D06F 2105/48* (2020.02)

(58) Field of Classification Search
CPC ..... D06F 39/087; D06F 35/00; D06F 35/005; D06F 35/007; D06F 58/38;
(Continued)

(56) References Cited

U.S. PATENT DOCUMENTS 3,043,125 A * 7/1962 Horecky ..... G05B 19/02 68/12.14
5,207,764 A 5/1993 Akabane et al.
(Continued)

FOREIGN PATENT DOCUMENTS

DE 102010016672 5/2011
EP 0711860 A1 5/1996
(Continued)

OTHER PUBLICATIONS

English machine translation of DE102010016672B3 published May 5, 2011 (10 pages).
(Continued)

*Primary Examiner* — David G Cormier
(74) *Attorney, Agent, or Firm* — J. Miguel Hernandez; James R. Gourley; Carstens, Allen & Gourley, LLP

(57) ABSTRACT

A washing machine has a rotatable drum for receiving items to be washed and a tub in which the drum is mounted for rotation. A first water sensor is located at or towards the bottom of the tub and is arranged to measure the level of water collected at the bottom of the tub. A second water sensor is located at a part of the tub away from the first water sensor and measures the amount of water being thrown out of the drum as the drum rotates. The drum is rotated in accordance with a difference of the outputs of the sensors.

10 Claims, 3 Drawing Sheets

(51) Int. Cl.
*D06F 105/48* (2020.01)
*D06F 103/18* (2020.01)

(58) Field of Classification Search
CPC ..... D06F 2103/02; D06F 2103/08; D06F 2103/18; D06F 2103/24; D06F 2105/08; D06F 2105/12; D06F 2105/46; D06F 2105/48
See application file for complete search history.

(56) References Cited

U.S. PATENT DOCUMENTS

| | | | | |
|---|---|---|---|---|
| 8,511,324 | B2 | 8/2013 | Komoto et al. | |
| 2013/0219741 | A1 | 8/2013 | Hong | |
| 2020/0308749 | A1* | 10/2020 | Ohyagi | D06F 39/08 |

FOREIGN PATENT DOCUMENTS

| | | | |
|---|---|---|---|
| EP | 2977502 | A1 | 1/2016 |
| KR | 1020130070817 | A | 6/2013 |
| WO | 2011/077361 | A1 | 6/2011 |

OTHER PUBLICATIONS

English machine translation of EP2977502A1 published Jan. 1, 2016 (10 pages).
English machine translation of KR20130070817 published Jun. 28, 2013 (7 pages).
International Search Report and Written Opinion for Application No. PCT/EP2019/066003 dated Jan. 16, 2020 (14 pages).

* cited by examiner

WASHING MACHINE AND METHOD OF OPERATION

CROSS REFERENCE TO RELATED APPLICATION

This application is a US 371 application from PCT/EP2019/066003 entitled "Washing Machine and Method of Operation" filed on Jun. 18, 2019 and published as WO 2020/253945 A1 on Dec. 24, 2020. The technical disclosures of every application and publication listed in this paragraph are hereby incorporated herein by reference.

TECHNICAL FIELD

The present disclosure relates to a washing machine and a method of operating a washing machine.

BACKGROUND

Washing machines are used for washing laundry items, including for example clothing, bedding, towels, etc. Some washing machines also provide a tumble dryer function, and are often referred to as combined washing-drying machines or washer-dryers or the like. As used herein, the term "washing machine" shall be understood to include machines that only provide a washing function and combined washing-drying machines which provide a washing function and a tumble drying function, unless the context requires otherwise.

A washing machine typically has a spin cycle which takes place after the washing cycle. During a spin cycle, the drum of the washing machine is rotated at a relatively high rate of rotation to cause excess water in the laundry to be spun out (through "centrifugal" force). This reduces the water content of the laundry before the laundry is removed from the washing machine to be dried (in a separate tumble dryer or on a washing line or the like) or before a tumble dryer function is implemented to dry the laundry in the case of a combined washer-dryer.

SUMMARY

According to a first aspect disclosed herein, there is provided a washing machine, the washing machine comprising:

a rotatable drum for receiving items to be washed;

a tub in which the drum is mounted for rotation;

a motor for driving rotation of the drum in the tub;

at least a first water sensor and a second water sensor;

the first water sensor being located at or towards the bottom of the tub and arranged to measure the level of water collected at the bottom of the tub;

the second water sensor being located at a part of the tub away from the first water sensor and arranged to measure the amount of water being thrown out of the drum as the drum rotates; and a controller for receiving outputs from the sensors and for controlling the motor to rotate the drum, wherein the controller is configured to control the motor to rotate the drum in accordance with a difference of the outputs of the sensors.

The use of (at least) two sensors enables a more accurate and more representative measurement of the amount of water remaining in the items in the drum to be obtained, in a way that is relatively simple and inexpensive to implement. The first waster sensor, located at or towards the bottom of the tub, effectively provides a baseline for the measurements by the second water sensor.

In an example, the controller is configured to control the motor to rotate the drum in accordance with a difference of the outputs of the sensors during a spin cycle such that the controller causes the spin cycle to cease when the magnitude of the difference of the outputs of the sensors exceeds a threshold.

In an example, the controller is configured such that the difference of the outputs of the sensors that is used by the controller to control the motor is an averaged difference.

This use of an averaged or "smoothed" difference helps to avoid "spikes" in the outputs of the sensors being acted upon incorrectly by the controller, given that spikes in the water that is collecting at the bottom of the tub and in the amount of water being thrown out of the drum as the drum rotates can occur in practice. The controller may carry out the averaging or smoothing.

In an example, at least one of the water sensors is a capacitive sensor.

In an example, each water sensor is a capacitive sensor.

According to a second aspect disclosed herein, there is provided a method of operating a washing machine having a rotatable drum containing items to be washed, the drum being mounted for rotation in a fixed tub of the washing machine, the method comprising:

rotating the drum;

measuring the level of water collected at the bottom of the tub;

measuring, at a part of the tub away from the bottom of the tub, the amount of water being thrown out of the drum as the drum rotates; and controlling rotation of the drum in accordance with a difference of the measurements.

In an example, the rotation of the drum is controlled in accordance with a difference of the measurements during a spin cycle such that the spin cycle is ceased when the magnitude of the difference of the measurements exceeds a threshold.

In an example, the method comprises averaging the difference of the measurements and controlling rotation of the drum in accordance with the averaged difference of the measurements.

In an example, at least one of the water sensors is a capacitive sensor.

BRIEF DESCRIPTION OF THE DRAWINGS

To assist understanding of the present disclosure and to show how embodiments may be put into effect, reference is made by way of example to the accompanying drawings in which.

DETAILED DESCRIPTION

As mentioned, washing machines are used for washing laundry items. Some washing machines also provide a tumble drying function, and are often referred to as combined washing-drying machines or washer-dryers or the like. As used herein, the term "washing machine" shall be taken to include machines that only provide a washing function and combined washing-drying machines which provide a washing function and a tumble drying function, unless the context requires otherwise.

Figure 1:
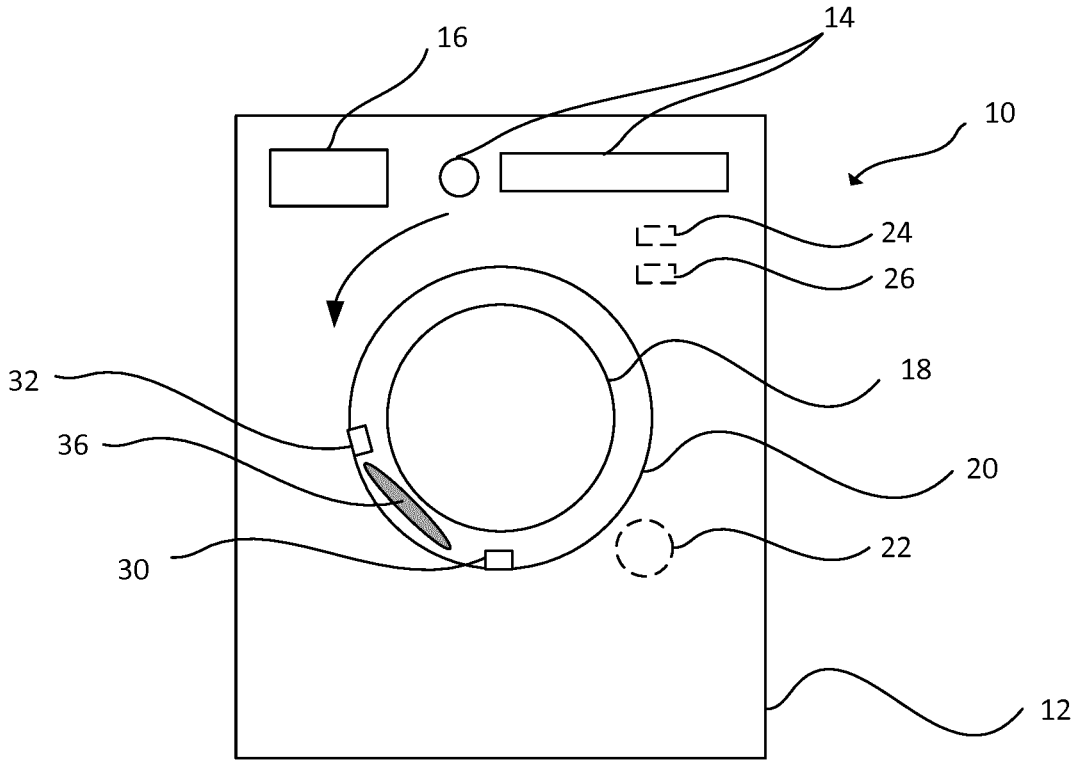
FIG. 1 shows schematically a front elevation of an example of a washing machine according to the present disclosure.
Figure 2:
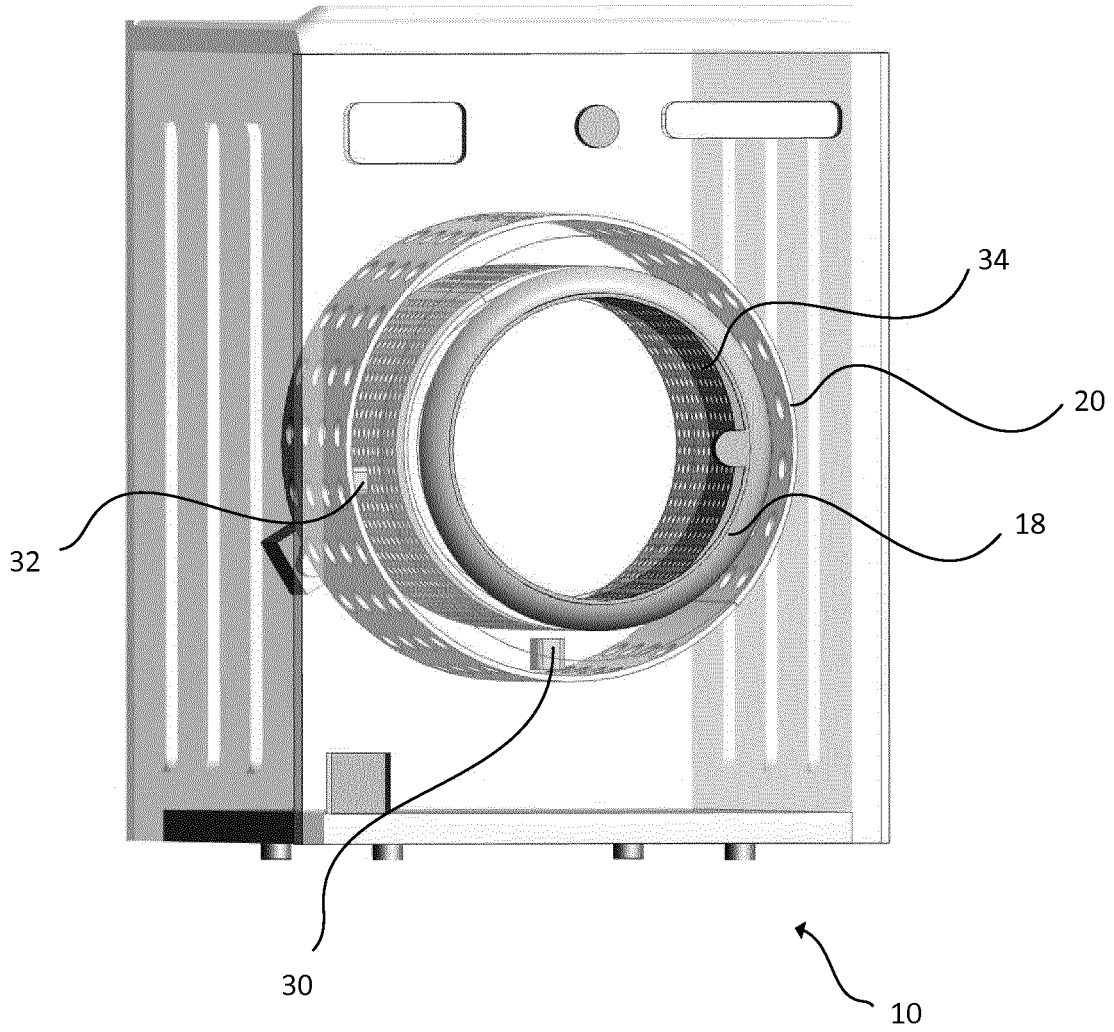
FIG. 2 shows schematically a front perspective view of the washing machine of FIG. 1, with some parts shown in phantom for clarity.

Referring now to the drawings, FIGS. 1 and 2 respectively show schematically a front elevation and a front perspective and partially phantom view of an example of a washing machine 10 according to the present disclosure. The washing machine 10 has a main outer housing 12. The housing 12 has one or more control panels, control knobs, etc. 14 for a user to set washing/drying programs and operating parameters such as temperature, spin speed, "delicate" wash, cotton wash, etc. The housing 12 also has a slide-out tray 16 into which washing detergent and/or fabric softener or the like may be loaded.

The washing machine 10 has a cylindrical drum 18 which is mounted for rotation within a tub 20. The tub 20 (sometimes also referred to as a tub assembly 20) is fixed relative to the housing 12 and provides support for the drum 18. An electric motor 22 is provided to rotate the drum 18 when required. The washing machine 10 further has a controller 24, for example a processor, etc., and data storage 26 for permanent storage of washing and/or drying programs and temporary storage of user settings, etc.

In use, as is well known, a user loads laundry to be washed into the drum 18 and typically selects a desired washing program via the control panel and/or control knob 14. The user can also often change one or more of the temperature of the water used for the wash, the spin speed of the drum 18, etc. within a selected washing program. In any event, once the wash cycle has been completed, typically the washing machine 10 carries out a spin cycle. During a spin cycle, the drum 18 of the washing machine 10 is rotated at a relatively high rate of rotation to cause excess water in the laundry to be spun out (through centrifugal force). This reduces the water content of the laundry before the laundry is removed from the washing machine 10 to be dried (in a separate tumble dryer or on a washing line or the like) or before a tumble dryer function is implemented to dry the laundry in the case of a combined washer-dryer 10.

In known washing machines, the duration of the spin cycle is often fixed and does not vary (though different fixed durations may be set by the washing machine according to the selected washing program). Likewise, in known washing machines, the rotational speed of the drum is often fixed and does not vary (though, again, different rotational speeds may be set by the washing machine according to the selected washing program, and the rotational speed can sometimes also be set manually by the user at the start of the wash). The duration of the spin cycle and/or the rotational speed of the drum in such a case are typically set once, by the manufacturer, based on tests carried out during production. Even if the user can set the rotational speed of the drum at the beginning of the wash, this speed again tends to be fixed for that wash. In any event, this can mean that if the washing machine 10 is lightly loaded with a relatively small amount of laundry, then energy is wasted in continuing to spin the laundry even though the laundry may have already been sufficiently dried during the spin cycle. Likewise, if the washing machine 10 is loaded with a large amount of laundry, this can mean that the washing has not been sufficiently dried during the spin cycle and is still very wet when the user removes the laundry from the washing machine or prior to a tumble dryer function being implemented in the case of a combined washer-dryer.

To address this, some known washing machines have a water level sensor which senses the water level in an outlet or drain pipe which passes from the tub assembly to a drain or the like to allow water to be drained out of and away from the washing machine. Once the water level in the outlet pipe has fallen below a predetermined threshold, it is determined that the laundry has been sufficiently dried during the spin cycle. The spin cycle is then stopped and the laundry can be removed by the user or subject to a tumble dry cycle in the case of a combined washer-dryer. A similar process may be carried out during a tumble dry cycle in the case of a combined washer-dryer, where again the amount of water that is being drained from the washing machine during the tumble drying is monitored to determine whether or not the laundry has been sufficiently dried. An example of such an arrangement which is used during a tumble dry cycle is disclosed in US2013219741A1. It is also known to provide the washing machine with a weight sensor to try to estimate the amount of water in the laundry.

However, a problem with such known arrangements is that they tend to be complex and therefore expensive to implement and/or they are not particularly accurate.

To address this, the washing machine 10 of the present example has (at least) two water sensors 30, 32. A first water sensor 30 is located at or towards the bottom of the tub 20. A second water sensor 32 is located at a part of the tub 20 away from the first water sensor 30. The outputs of the first and second water sensors 30, 32 are passed to the controller 24. The controller 24 controls the motor 22 to rotate the drum 18 in accordance with a difference of the outputs of the first and second water sensors 30, 32. In short, the first water sensor 30 measures the level of water collected at the bottom of the tub 20; the second water sensor 32 measures the amount of water being thrown out of the drum 18 as the drum rotates. The first water sensor 30 in a sense acts as a baseline or reference for measurements by the second water sensor 32. Once the controller 22 has determined that the laundry has sufficiently dried during a spin cycle, the controller 22 can effectively cause the spin cycle to cease.

Figure 3:
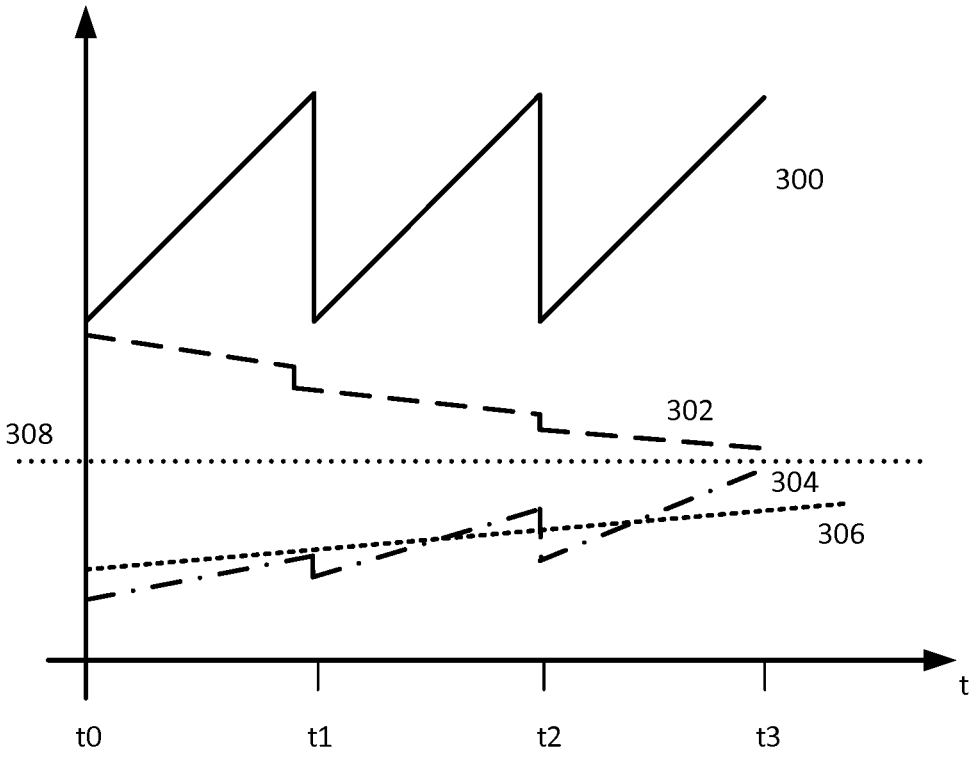
FIG. 3 shows schematically outputs of sensors of the washing machine of FIG. 1 and a difference of the outputs of the sensors over time.

Discussing the example further, as mentioned, the first water sensor 30 is located at or towards the bottom of the tub 20, a the "6 o-clock" position or at 180° where 0° is at the top of the tub 20, to measure the level of water collected at the bottom of the tub 20 during the spin cycle. As will be familiar, in a washing machine 10, the drum 18 has through holes 34 through which water is thrown by centrifugal force during a spin. This water that has been thrown out of the drum 18 enters the annular space between the drum 18 and the tub 20, as indicated in part by the reference numeral 36 in FIG. 1. This water that has been thrown out of the drum 18 collects or "pools" at the bottom of the tub 20, in the space between the drum 18 and the tub 20. Reference is now made to FIG. 3, which shows schematically outputs of the sensors 30, 32 over time. The output of the first water sensor 30 is shown schematically at 300. The time t0 may be regarded as the start of the spin cycle. In the time interval up to t1, the drum 18 is rotated or spun. This causes water to be thrown out of the drum 18. The water 36 in the annular space between the drum 18 and the tub 20 tends to fall downwards, such that the level of water at the bottom of the tub 20 rises. At a point t1, the spinning of the drum 18 is stopped. A pump (not shown) of the washing machine 10 is then operated to drain the water from the tub 20. This causes a sharp drop in the level of water at the bottom of the tub 20 at the time t1. The spin cycle is then continued by rotating the drum 18 again up to a time t2. Again, as can be seen, the water level at the bottom of the tub 20 rises until, at time t2, the drum 18 is stopped and the water pumped out again. This is typically repeated a number of times.

Whereas the first water sensor 30 is measuring the level of water that collects at the bottom of the tub 20, the second water sensor 32 is measuring the amount of water that is being thrown out of the rotating drum 18 at any particular point in time. As mentioned, the second water sensor 32 is located away from the first water sensor 30. In this example, the second water sensor 32 is located towards one side of the drum 18, generally at around the "8 o'clock" or 240° position or at around the "9 o'clock" or 270° position. More generally, the second water sensor 32 may be located anywhere from say the "7 o'clock" position, over the top of the drum 18, to the "5 o'clock" position, that is, somewhere in the approximate angular range −150° to +150° where 0° is at the top.

The output of the second water sensor 32 is shown schematically at 302 in FIG. 3. At the beginning of the time when the drum 18 is first rotated (i.e. at time instant t0), the amount of water being thrown out is relatively high. As the laundry items located within the drum 18 lose water as the drum 18 is spun, the amount of water that is thrown out of the drum 18 drops. At the time instant t1, the drum 18 has been stopped. The water level measured by the second water sensor 32 drops sharply by a small amount as the water drains to the bottom of the annular space between the drum 18 and the tub 20. At the time instant t2, the drum 18 is spun again and the water level measured by the second water sensor 32 drops more slowly again (because the water is held up in the space between the drum 18 and the tub 20 when the drum 18 is rotating). This repeats a number of times as the drum 18 is spun and then stopped and the water is pumped out of the machine 10.

The controller 24 receives the outputs of the two sensors 30, 32 during this period. The controller 24 subtracts the value of the output of one sensor 30, 32 from the value of the output of the other sensor 30, 32. (The outputs of one or both of the two sensors 30, 32 may be scaled, by multiplying by a constant, as necessary prior to the subtraction of the outputs.) Here, the controller 24 subtracts the value of the output 302 of the second sensor 32 from the value of the output 300 of the first sensor 30, but the subtraction can equivalently be the other way round and the magnitude of the difference used.

In any event, the (magnitude of the) difference of the outputs of the two sensors 30, 32 is indicated at 304 in FIG. 3. As can be seen, the difference increases over time. This reflects the fact that water is being spun out of the laundry in the drum 18 (the falling of the output 302 of the second sensor 32) but over time on average the median value of the level of water at the bottom of the tub 20 is more or less constant (the output 300 of the first sensor 30). (For completeness, it is mentioned that the level of water at the bottom of the tub 20 will itself ultimately drop as the water is finally pumped out, this not being shown in FIG. 3.)

Once this difference exceeds a threshold 308, this can be regarded as an indicator that the laundry items in the drum 18 have been sufficiently dried during the spin cycle. When comparing the difference to the threshold 308, the controller 24 may take an average or otherwise smooth the measured difference as indicated at 306 in FIG. 3. This helps to avoid "spikes" in the output of one or both of the sensors 30, 32 leading to an incorrect decision by the controller 24 that the laundry has sufficiently dried. The controller 24 may multiply the difference by a constant prior to comparing the difference with the threshold, again for scaling purposes.

The controller 24 continues the spin cycle, with rotation of the drum 18 being followed by pumping out of the water, until the threshold 308 is exceeded. As a failsafe, the spin cycle may be continued only for a certain period of time or for a certain number of cycles of rotation of the drum 18 and pumping out of the water, even if the threshold 308 has not been exceeded.

Once the threshold 308 has been exceeded by the difference 304, 306 of the outputs of the sensors 30, 32, the spin cycle can be caused to cease by the controller 24. In the case that the washing machine 10 is only a washing machine or the user has not selected a tumble dry function in the case that the washing machine 10 is a combined washer-dryer, the laundry items can then be removed (with the controller 24 typically unlocking a door that allows access to the drum 18). In the case that the washing machine 10 is a combined washer-dryer and the user has selected a tumble dry function, the controller 24 may then initiate the tumble dry function.

The sensors 30, 32 may be one of a number of different types. One or both of the sensors 30, 32 may be for example a capacitive level sensor, a conductive level sensor, a resistive sensor, an optical sensor, etc. The sensors 30, 32 may be analogue and measurements are carried out on the board on which the sensors 30, 32 are mounted. Alternatively, the sensors 30, 32 may have an on-board analogue-to-digital converter (ADC) and provide outputs in a serial communication format, such as for example SPI (Serial to Peripheral Interface) or I2C (Inter-Integrated Circuit) or similar. Either way, in an example digital values are converted to unitless values, such as in the range 0-255 or 0-1024.

There may be a number of second sensors 32 located at other positions in the space between the drum 18 and the tub 20. The controller 24 in that case can use the outputs of the plural second sensors 32 in conjunction with the output of the first sensor 30 at the bottom of the tub 20. This can provide a more accurate measurement of the water being thrown out of the drum 18 during spinning.

It will be understood that the processor or processing system or circuitry referred to herein may in practice be provided by a single chip or integrated circuit or plural chips or integrated circuits, optionally provided as a chipset, an application-specific integrated circuit (ASIC), field-programmable gate array (FPGA), digital signal processor (DSP), graphics processing units (GPUs), etc. The chip or chips may comprise circuitry (as well as possibly firmware) for embodying at least one or more of a data processor or processors, a digital signal processor or processors, baseband circuitry and radio frequency circuitry, which are configurable so as to operate in accordance with the exemplary embodiments. In this regard, the exemplary embodiments may be implemented at least in part by computer software stored in (non-transitory) memory and executable by the processor, or by hardware, or by a combination of tangibly stored software and hardware (and tangibly stored firmware).

Reference is made herein to data storage for storing data. This may be provided by a single device or by plural devices. Suitable devices include for example a hard disk and non-volatile semiconductor memory (including for example a solid-state drive or SSD).

Although at least some aspects of the embodiments described herein with reference to the drawings comprise computer processes performed in processing systems or processors, the invention also extends to computer programs, particularly computer programs on or in a carrier, adapted for putting the invention into practice. The program may be in the form of non-transitory source code, object code, a code intermediate source and object code such as in partially compiled form, or in any other non-transitory form suitable for use in the implementation of processes according to the invention. The carrier may be any entity or device capable of carrying the program. For example, the carrier may comprise a storage medium, such as a solid-state drive (SSD) or other semiconductor-based RAM; a ROM, for example a CD ROM or a semiconductor ROM; a magnetic recording medium, for example a floppy disk or hard disk; optical memory devices in general; etc.

The examples described herein are to be understood as illustrative examples of embodiments of the invention. Further embodiments and examples are envisaged. Any feature described in relation to any one example or embodiment may be used alone or in combination with other features. In addition, any feature described in relation to any one example or embodiment may also be used in combination with one or more features of any other of the examples or embodiments, or any combination of any other of the examples or embodiments. Furthermore, equivalents and modifications not described herein may also be employed within the scope of the invention, which is defined in the claims.

The invention claimed is:

1. A washing machine, the washing machine comprising:
a rotatable drum for receiving items to be washed;
a tub in which the drum is mounted for rotation;
a motor for driving rotation of the drum in the tub;
at least a first water sensor and a second water sensor;
the first water sensor being located at or towards the bottom of the tub and arranged to measure a level of water collected at the bottom of the tub;
the second water sensor being located at a part of the tub away from the first water sensor and arranged to measure an amount of water being thrown out of the drum as the drum rotates; and
a controller for receiving outputs from the sensors and for controlling the motor to rotate the drum, wherein the controller is configured to control the motor to rotate the drum in accordance with a difference of the outputs of the sensors during a spin cycle such that the controller causes the spin cycle to cease when the magnitude of the difference of the outputs of the sensors exceeds a threshold.

2. A washing machine according to claim 1, wherein at least one of the water sensors is a capacitive sensor.

3. A washing machine according to claim 2, wherein each water sensor is a capacitive sensor.

4. A washing machine, the washing machine comprising:
a rotatable drum for receiving items to be washed;
a tub in which the drum is mounted for rotation;
a motor for driving rotation of the drum in the tub;
at least a first water sensor and a second water sensor;
the first water sensor being located at or towards the bottom of the tub and arranged to measure a level of water collected at the bottom of the tub;
the second water sensor being located at a part of the tub away from the first water sensor and arranged to measure an amount of water being thrown out of the drum as the drum rotates; and
a controller for receiving out puts from the sensors and for controlling the motor to rotate the drum, wherein the controller is configured to control the motor to rotate the drum in accordance with a difference of the outputs of the sensors, wherein the controller is configured such that the difference of the outputs of the sensors that is used by the controller to control the motor is a smoothed difference which is smoothed over time.

5. A washing machine according to claim 4, wherein at least one of the water sensors is a capacitive sensor.

6. A washing machine according to claim 5, wherein each water sensor is a capacitive sensor.

7. A method of operating a washing machine having a rotatable drum containing items to be washed, the drum being mounted for rotation in a fixed tub of the washing machine, the method comprising:
rotating the drum;
measuring a level of water collected at the bottom of the tub;
measuring at a part of the tub away from the bottom of the tub, and amount of water being thrown out of the drum as the drum rotates; and
controlling rotation of the drum in accordance with a difference of the measurements during a spin cycle such that the spin cycle is ceased when the magnitude of the difference of the measurements exceeds a threshold.

8. A method according to claim 7, wherein at least one of the water sensors is a capacitive sensor.

9. A method of operating a washing matching having a rotatable drum containing items to be washed, the drum being mounted for rotation in a fixed tub of the washing machine, the method comprising:
rotating the drum;
measuring a level of water collected at the bottom of the tub;
measure, at a part of the tub away from the bottom of the tub, an amount of water being thrown out of the drum as the drum rotates; and
controlling rotation of the drum in accordance with a difference of the measurements, wherein the difference of the measurements is a smoothed difference which is smoothed over time.

10. A method according to claim 9, wherein at least one of the water sensors is a capacitive sensor.

* * * * *